US009976758B2

(12) United States Patent
Suzuki et al.

(10) Patent No.: US 9,976,758 B2
(45) Date of Patent: May 22, 2018

(54) INDOOR UNIT OF AIR CONDITIONING DEVICE WITH INSULATED AIR PASSAGE

(71) Applicant: Mitsubishi Electric Corporation, Tokyo (JP)

(72) Inventors: Akimoto Suzuki, Tokyo (JP); Masato Ishikawa, Tokyo (JP); Masahide Kinami, Tokyo (JP); Hisanori Ikeda, Tokyo (JP); Youhei Koyanagi, Tokyo (JP); Takuya Goto, Tokyo (JP); Shinji Kawai, Tokyo (JP); Katsuya Ishigami, Tokyo (JP); Yosuke Naito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 137 days.

(21) Appl. No.: 14/688,285

(22) Filed: Apr. 16, 2015

(65) Prior Publication Data

US 2016/0025357 A1 Jan. 28, 2016

(30) Foreign Application Priority Data

Jul. 23, 2014 (JP) ..... 2014-149725

(51) Int. Cl.
*F24F 1/00* (2011.01)
*F24F 13/20* (2006.01)
*F24F 13/32* (2006.01)

(52) U.S. Cl.
CPC ..... *F24F 1/0018* (2013.01); *F24F 1/0007* (2013.01); *F24F 13/20* (2013.01); *F24F 13/32* (2013.01); *F24F 2001/0048* (2013.01)

(58) Field of Classification Search
CPC ..... F24F 13/20; F24F 13/32; F24F 1/0007; F24F 1/0018; F24F 2001/0048; F24F 13/222
See application file for complete search history.

(56) References Cited

U.S. PATENT DOCUMENTS 6,701,738 B2 * 3/2004 Kobayashi ..... F24F 1/027 454/201
7,398,654 B2 * 7/2008 Choi ..... F24F 1/027 62/285

FOREIGN PATENT DOCUMENTS

EP 2299193 A2 3/2011
EP 2719970 A2 4/2014
(Continued)

OTHER PUBLICATIONS

Extended European Search Report dated Mar. 31, 2016 in the corresponding EP application No. 15168278.8.
(Continued)

*Primary Examiner* — Frantz Jules
*Assistant Examiner* — Filip Zec
(74) *Attorney, Agent, or Firm* — Posz Law Group, PLC

(57) ABSTRACT

An indoor unit of an air conditioning device which is installed on a wall surface of a room includes an air sending fan which sends room air from an air inlet disposed at an upper part to an air outlet disposed at a lower part of a front side; heat exchangers disposed at the upstream side of the air sending fan; and a back case which is located close to the wall surface with respect to the air sending fan and supports the heat exchangers, wherein the back case is composed of an air outlet passage wall member which forms an air outlet passage for air blown out from the air sending fan and an installation member which is located on a back side of the air outlet passage wall member and is mounted on an installation plate which is fixed on the wall surface with the air outlet passage wall member and the installation member being arranged in parallel in the front and back direction, and a first space is formed between a back surface of an air outlet passage wall of the air outlet passage wall member and the installation member.

18 Claims, 14 Drawing Sheets

(56) References Cited

FOREIGN PATENT DOCUMENTS

| | | | |
|---|---|---|---|
| JP | S50-60839 | U | 6/1975 |
| JP | H11-101464 | A | 4/1999 |
| JP | 2003-207162 | A | 7/2003 |
| JP | 2004-011941 | A | 1/2004 |
| JP | 2004-069105 | A | 3/2004 |
| JP | 2014-070761 | A | 4/2014 |
| WO | 2013/140895 | A1 | 9/2013 |

OTHER PUBLICATIONS

Office Action dated Jun. 27, 2017 issued in corresponding JP application No. 2014-149725 (and English translation).
Office Action dated Nov. 23, 2017 issued in corresponding CN patent application No. 201510196689.4 (and English translation).
Office Action dated Jul. 28, 2017 issued in corresponding CN patent application No. 201510196689.4 (and English translation).

* cited by examiner

X-X CROSS SECTION

Y-Y CROSS SECTION

Z-Z CROSS SECTION

INDOOR UNIT OF AIR CONDITIONING DEVICE WITH INSULATED AIR PASSAGE

TECHNICAL FIELD

The present invention relates to an indoor unit of an air conditioning device, and more specifically, to a configuration of a wall hanging type indoor unit which is mounted on a wall surface of a room.

BACKGROUND ART

In indoor units of separate type air conditioning devices which include an indoor unit and an outdoor unit, most indoor units which are hung on the upper part of the wall surface of the room to be air conditioned include an air inlet for the room air formed on the top of the housing of the indoor unit. The indoor units further include a heat exchanger and an air sending fan in the housing, and the room air which is introduced from the air inlet on the top into the housing by rotating an air sending fan is cooled or heated by the heat exchanger so as to provide conditioned air from an air outlet disposed in a lower part on the front side of the housing.

An air outlet passage wall is disposed on the back side of the air sending fan so as to guide the room air blown out by the air sending fan to the air outlet. The heat exchanger and the air sending fan are held by the back case which includes the integrally formed air outlet passage wall, and fixed on the installation plate which is mounted on the wall surface of the room (for example, see Patent Literature 1).

CITATION LIST

Patent Literature

[Patent Literature 1] Japanese Unexamined Patent Application Publication No. 2004-69105 (FIG. 1)

SUMMARY OF INVENTION

Technical Problem

In the indoor unit of an air conditioning device described in Patent Literature 1, since the conditioned air cooled by the heat exchanger and having a temperature lower than that of the room air flows in the air outlet passage during a cooling operation, the air outlet passage wall is also cooled by the conditioned air. As a result, moisture contained in the air which flows in and out of the space on the back side of the back case is cooled by the air outlet passage wall and condensed, and is deposited on the back surface of the back case as droplets of water (dew condensation water). As a consequence, droplets of the dew condensation water may drop onto the floor of the room.

In order to prevent dew condensation water on the back surface of the back case from dropping onto the floor of the room, there is a need of providing a prevention unit, for example, a water droplet prevention unit such as a dew condensation water collecting mechanism that collects dew condensation water and guides it to the outside of the room, on the back side of the back case so as to prevent dropping of dew condensation water onto the outside of the indoor unit.

The present invention has been made to solve the above problem and aims to prevent dew condensation from being generated on the back surface of the back case during a cooling operation.

Solution to Problem

According to the present invention, an indoor unit of an air conditioning device which is hung on a wall surface of a room includes an air sending fan which sends room air from an air inlet disposed at an upper part to an air outlet disposed at a lower part on a front side; a heat exchanger disposed at an upstream side of the air sending fan; and a back case which is located close to the wall surface with respect to the air sending fan and supports the heat exchanger, wherein the back case includes an air outlet passage wall member which forms an air outlet passage for air blown out from the air sending fan and an installation member which is located on a back side of the air outlet passage wall member and is mounted on an installation plate which is fixed on the wall surface, with the air outlet passage wall member and the installation member being arranged in parallel in the front and back direction, and a first space is formed between a back surface of an air outlet passage wall of the air outlet passage wall member and the installation member.

Advantageous Effects of Invention

According to the present invention, the indoor unit of an air conditioning device which is capable of preventing dew condensation from being generated on the back surface of the back case during a cooling operation can be provided.

DESCRIPTION OF EMBODIMENTS

Embodiment 1

Figure 1:
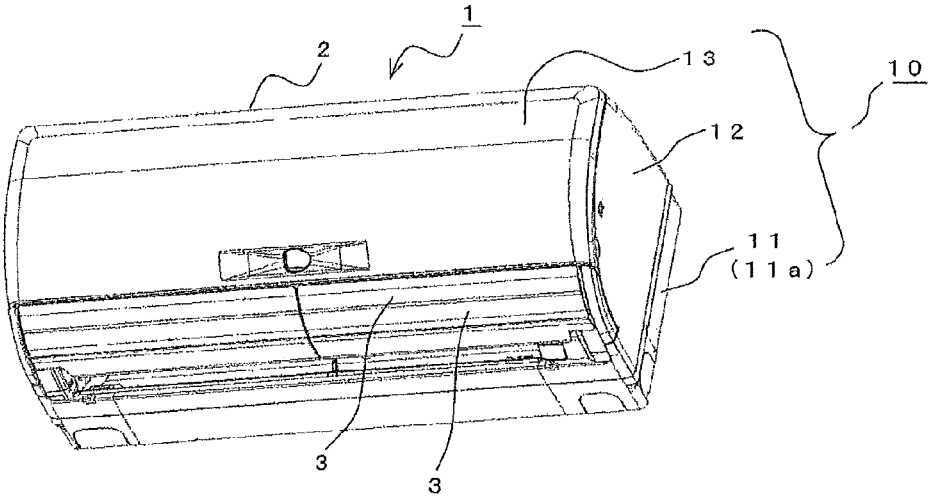
FIG. 1 is a perspective view of an indoor unit of an air conditioning device according to Embodiment 1 of the present invention.
Figure 2:
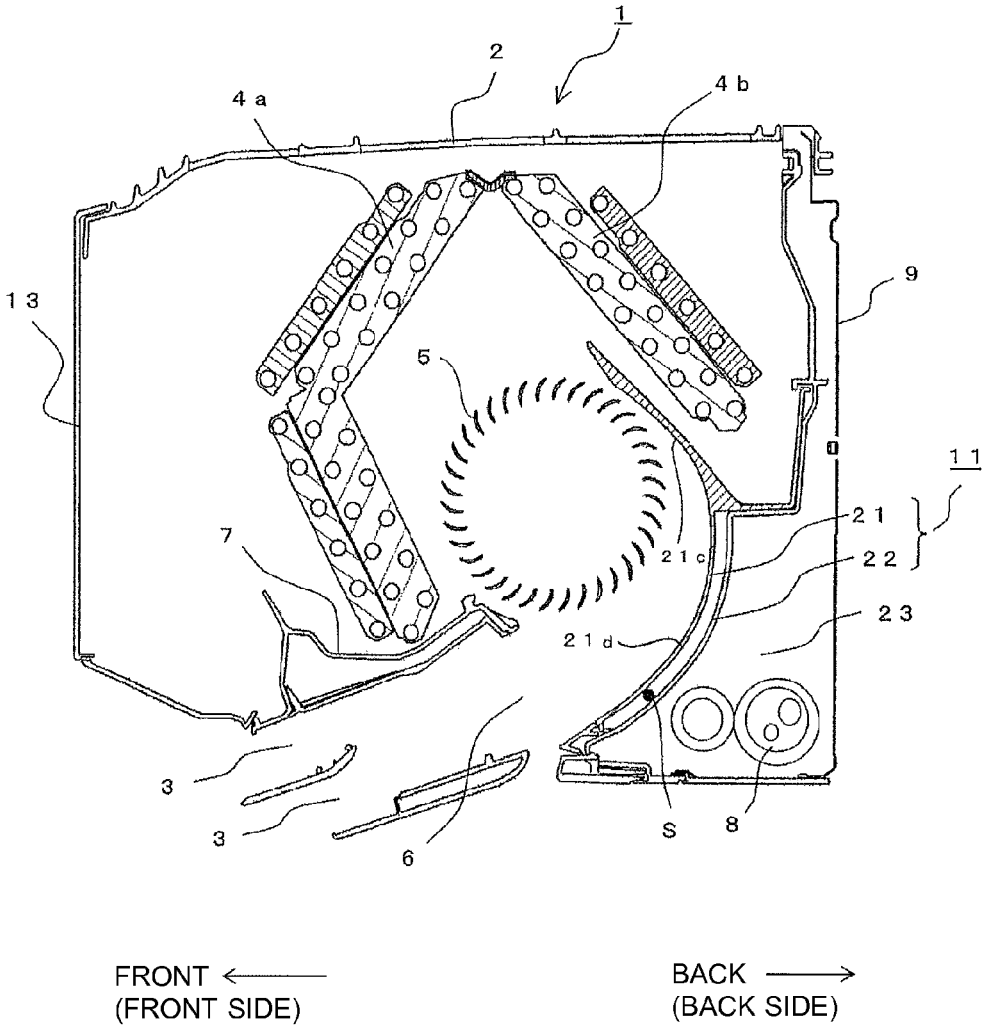
FIG. 2 is a vertical sectional view of the indoor unit of FIG. 1.

FIG. 1 is a perspective view of an indoor unit of an air conditioning device according to Embodiment 1 of the present invention. FIG. 2 is a vertical sectional view of the indoor unit of FIG. 1. An indoor unit 1 is connected to an outdoor unit (not shown) which is disposed outside the building via a cooling pipe so as to form a refrigeration cycle.

The indoor unit 1 is a wall hanging type unit which is hung on the upper part of the wall of the room to be air-conditioned and includes a housing 10 in the form of a cuboid made up of a back case 11, side panels 12, a front panel 13 and having a longer dimension in the right and left direction as shown in the figure. An air sending fan 5 and a heat exchanger 4 are disposed in the housing 10, and the heat exchanger 4 is located upstream of the air sending fan 5 so as to cover the air sending fan 5. The heat exchanger 4 is made up of a front side heat exchanger 4*a* and a back side heat exchanger 4*b* which are disposed front side and back side in the housing 10, respectively. The air sending fan 5 is a cross flow fan having an elongated cylindrical shape and is horizontally disposed with the longitudinal direction being oriented in the right and left direction of the housing 10. The heat exchanger 4 and the air sending fan 5 have their ends in the longitudinal direction supported by the back case 11. As shown in FIG. 1, the both ends of the back case 11 are covered by the side panels 12, and only back case side surfaces 11*a* are exposed to the outside. The detailed configuration of the back case 11 will be described later.

In the indoor unit 1, a direction facing to the wall of the room in which the indoor unit 1 is installed is hereinafter referred to as back side or back, while the opposite direction is hereinafter referred to as front side or front, and a direction which extends between the front side and the back side is hereinafter referred to as front and back direction or depth direction. Further, a direction in which the cuboid housing 10 extends is referred to as longitudinal direction, right and left direction, rotation axis direction of the air sending fan 5.

An air inlet 2 as an inlet of room air is disposed on the top of the housing 10, and an air outlet 3 is disposed in the lower part of the front side of the housing 10 so as to extend in the right and left direction of the indoor unit 1. The air outlet 3 extends in the same direction as the longitudinal direction of the housing 10. A drain pan 7 is disposed under the front side heat exchanger 4*a* so as to receive droplets of dew condensation water from the surface of the front side heat exchanger 4*a*. Dew condensation water received in the drain pan 7 is guided to the outside of the room by a drainage mechanism (not shown).

An air outlet passage 6 is disposed on the front side of the back case 11 such that air is blown out from the air sending fan 5 to the air outlet 3 through the air outlet passage 6. An air outlet passage wall 21*a* which is made up of an upper air outlet passage wall 21*c* and a lower air outlet passage wall 21*d* is formed in a curve concave to the air outlet passage 6, and forms a back side wall of the air outlet passage 6. A connection pipe storage section 23 which houses a refrigerant pipe 8 is disposed between the back side of the back case 11 and an installation plate 9.

The back case 11 is composed of two members, which are an air outlet passage wall member 21 located on the back side of the air sending fan 5 and an installation member 22 located on the back side of the air outlet passage wall member 21. The air outlet passage wall member 21 and the installation member 22 are disposed in parallel and spaced from each other in the front and back direction. The right and left direction of both the air outlet passage wall member 21 and the installation member 22 extend in the longitudinal direction of the housing 10. Since the air outlet passage wall member 21 and the installation member 22 are spaced from each other in the front and back direction, a first space S is formed between the back side of the air outlet passage wall 21*a* of the air outlet passage wall member 21 and the installation member 22.

The first space S (hereinafter, referred to as space S) is a space of, for example, approximately 0.5 mm to 10 mm in the front and back direction and approximately the same length as that of the longitudinal direction of the housing 10 in the right and left direction.

Figure 3:
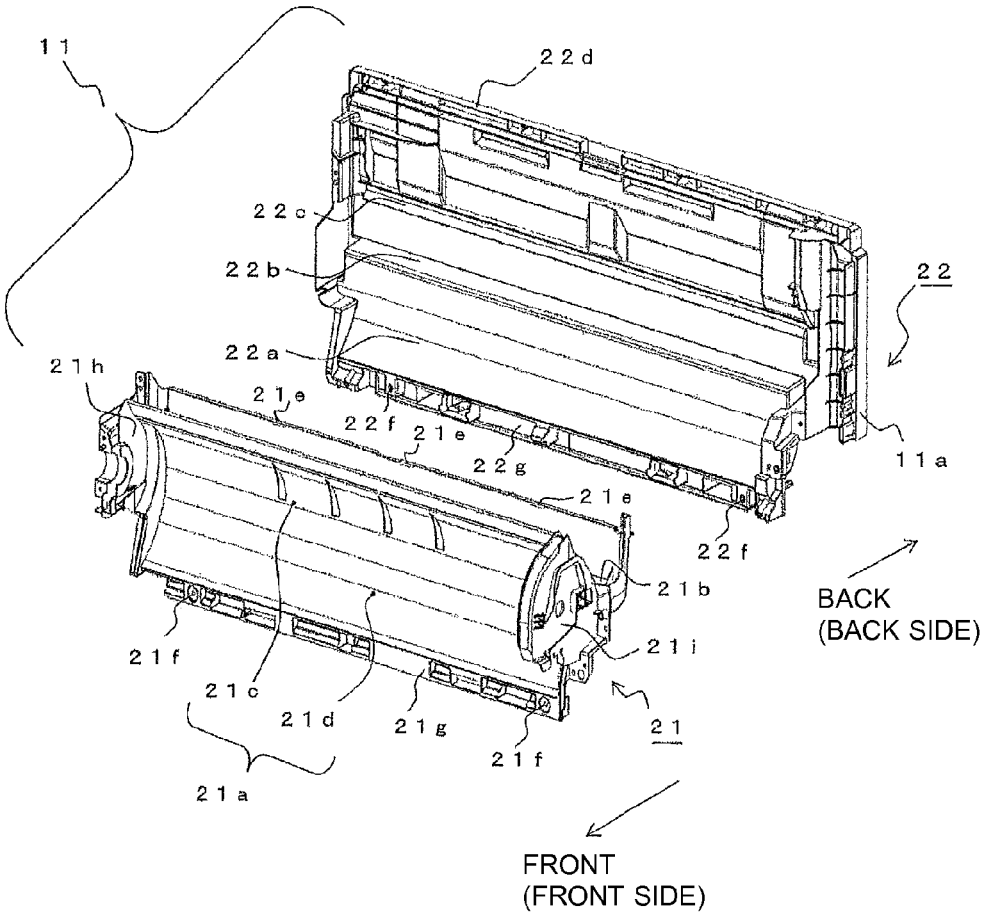
FIG. 3 is a perspective view which shows an air outlet passage wall member and an installation member which form a back case according to Embodiment 1 of the present invention in a disassembled state.
Figure 4:
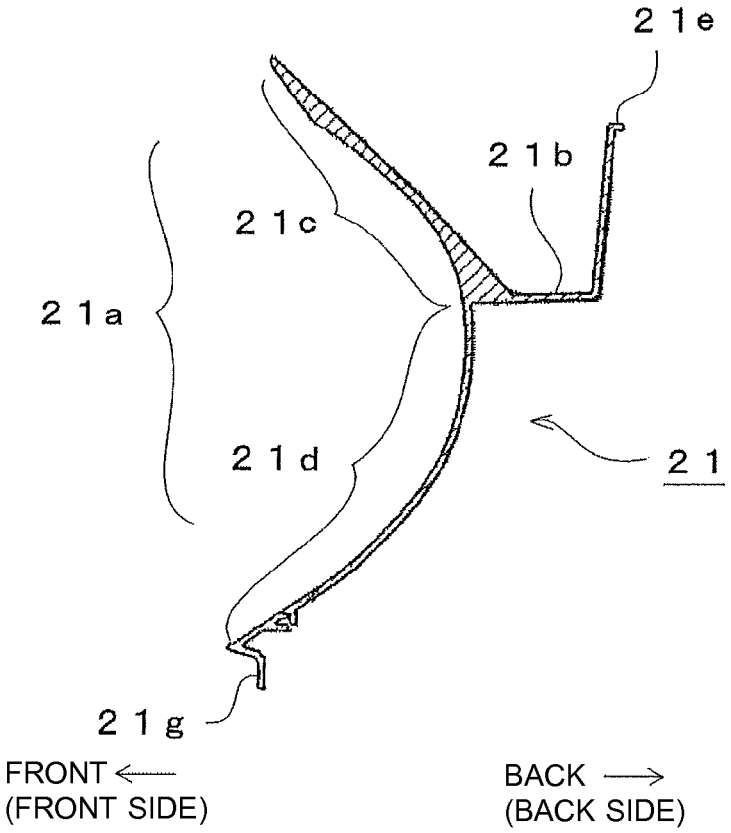
FIG. 4 is a vertical sectional view of an air outlet passage wall member according to Embodiment 1 of the present invention.
Figure 5:
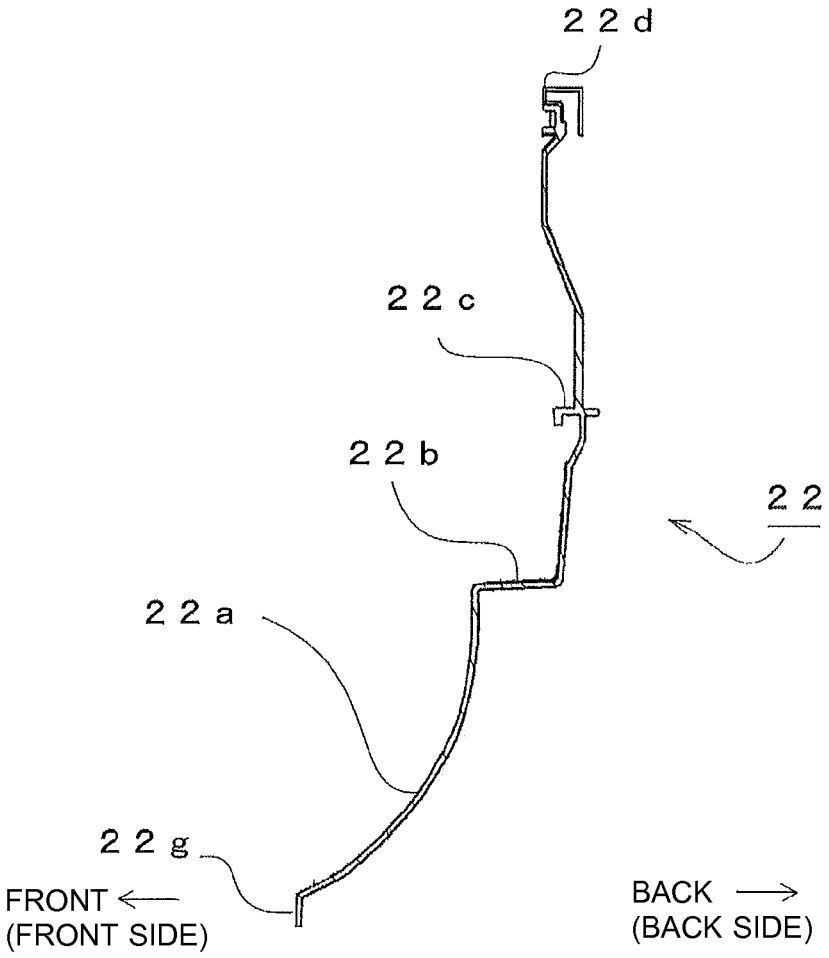
FIG. 5 is a vertical sectional view of an installation member according to Embodiment 1 of the present invention.
Figure 6:
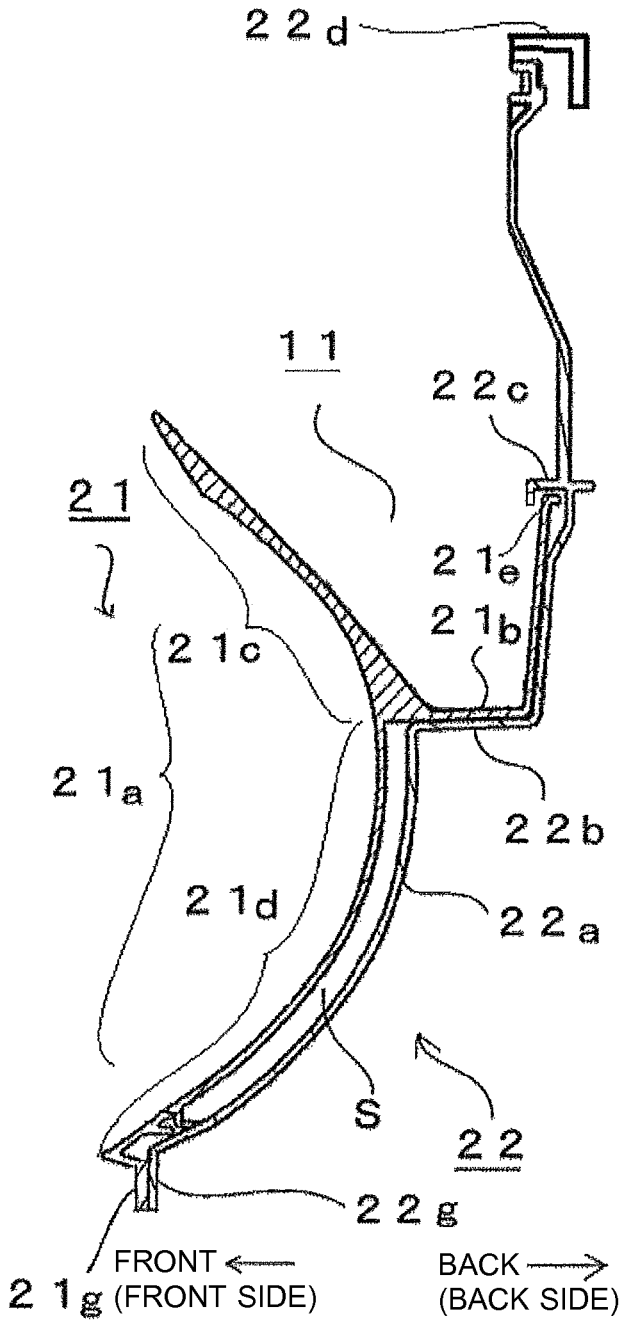
FIG. 6 is a vertical sectional view of the back case according to Embodiment 1 of the present invention.

FIG. 3 is a perspective view which shows the air outlet passage wall member 21 and the installation member 22 which form the back case 11, FIG. 4 is a vertical sectional view of the air outlet passage wall member 21 at the center in the right and left direction, FIG. 5 is a vertical sectional view of the installation member 22 at the center in the right and left direction, and FIG. 6 is a vertical sectional view of the back case 11 with the air outlet passage wall member 21 and the installation member 22 being assembled. The installation member 22 is formed longer than the air outlet passage wall member 21 in the up and down direction.

As shown in FIGS. 3 and 4, the air outlet passage wall member 21 which is located close to the wall surface with respect to the air sending fan 5 includes the air outlet passage wall 21*a* which forms the back wall of the air outlet passage 6 and a drain pan section 21*b* which extends in an L-shape in the cross section to the back side of the air outlet passage wall 21*a*. The air outlet passage wall 21*a* is made up of the upper air outlet passage wall 21*c* having the drain pan section 21*b* formed on the back side and the lower air outlet passage wall 21*d* located downward of the drain pan section 21*b*. The upper air outlet passage wall 21*c* and the lower air outlet passage wall 21*d* collectively form the air outlet passage wall 21*a* having the shape of a curve concave to the air outlet passage 6.

Further the back side heat exchanger 4*b* is disposed on the back side of the upper air outlet passage wall 21*c*, and the drain pan section 21*b* is located under the back side heat exchanger 4*b*. The drain pan section 21*b* has a shape which extends under the back side heat exchanger 4*b* and extends upward on the back side of the back side heat exchanger 4*b*. The back side of the upper air outlet passage wall 21*c* and the drain pan section 21*b* form a recess shape in the cross section under the back side heat exchanger 4*b* so as to receive droplets of dew condensation water from the back side heat exchanger 4*b*. Claws 21*e* which protrude backward are formed at a plurality of positions in the longitudinal direction on the back side of the end of the drain pan section 21*b* so as to engage with the installation member 22.

The air sending fan 5 is rotatably supported by a left side plate 21*h* and a right side plate 21*i* formed on the left side end and right side end in the longitudinal direction of the air outlet passage wall member 21, respectively. The front side heat exchanger 4*a* and the back side heat exchanger 4*b* are also supported by the left side plate 21*h* and the right side plate 21*i* at each end.

As shown in FIGS. 3 and 5, the installation member 22 includes an air outlet passage wall facing section 22*a* which faces the lower air outlet passage wall 21*d*, a drain pan section facing section 22*b* which is continuous from the air outlet passage wall facing section 22*a* and faces the drain pan section 21*b*, and an upper end 22*d* which extends upward from the back side of the drain pan section facing section 22*b*. The upper end 22*d* is located at the same level as the top of the housing 10, and the claws disposed at a plurality of positions in the longitudinal direction of the upper end 22*d* are hung on the metal installation plate 9 to be fixed thereto (see FIG. 2) such that the installation member 22 is fixed on the wall surface of the room to be air-conditioned. Further, a claw fixation section 22*c* in which the claws 21*e* are inserted and fixed is formed at a position lower than the upper end 22*d* of the installation member 22 and corresponds to the claw 21*e* of the air outlet passage wall member 21.

Further, fitting sections formed of, for example, projections and recesses are disposed at a plurality of positions in the longitudinal direction for facilitating alignment between a lower end 21*g* of the air outlet passage wall member 21 and a lower end 22*g* of the installation member 22. Further, insertion holes 21*f* and screw holes 22*f* for bolt fixation are formed on each end in the longitudinal direction of the lower end 21*g*, 22*g*.

As shown in FIG. 6, the back case 11 is formed of the air outlet passage wall member 21 and the installation member 22 which are assembled by fixing the claws 21*e* of the air outlet passage wall member 21 to the claw fixation section 22*c* of the installation member 22 and assembling the insertion holes 21*f* of the air outlet passage wall member 21 with the screw holes 22*f* of the installation member 22.

In the above described configuration for assembling the air outlet passage wall member 21 and the installation member 22, for example, claw fixation of the claws 21*e* and the claw fixation section 22*c* or bolt fixation using the insertion holes 21*f* and the screw holes 22*f* is used. However, the invention is not limited thereto, and only claw fixation or claw fixation may be used, or alternatively, adhesion may be used.

As shown in FIG. 6, when the back case 11 is formed by assembling the air outlet passage wall member 21 and the installation member 22, the space S is formed between the lower air outlet passage wall 21*d* of the air outlet passage wall member 21 and the air outlet passage wall facing section 22*a* of the installation member 22. Further, the installation member 22 is longer than the air outlet passage wall member 21, and the air outlet passage wall member 21 and the installation member 22 are fixed by aligning the lower end 21*g* and the lower end 22*g*, and accordingly, the back case 11 is formed when the installation member 22 is assembled while extending upward from the air outlet passage wall member 21.

Figure 7:
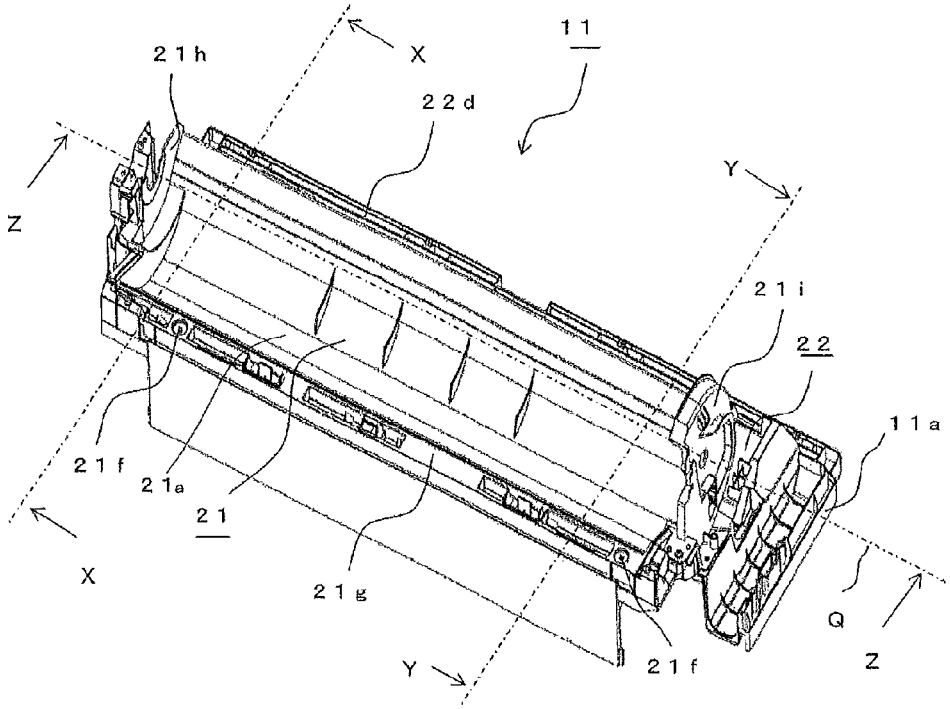
FIG. 7 is an explanatory view of the back case according to Embodiment 1 of the present invention.
Figure 8:
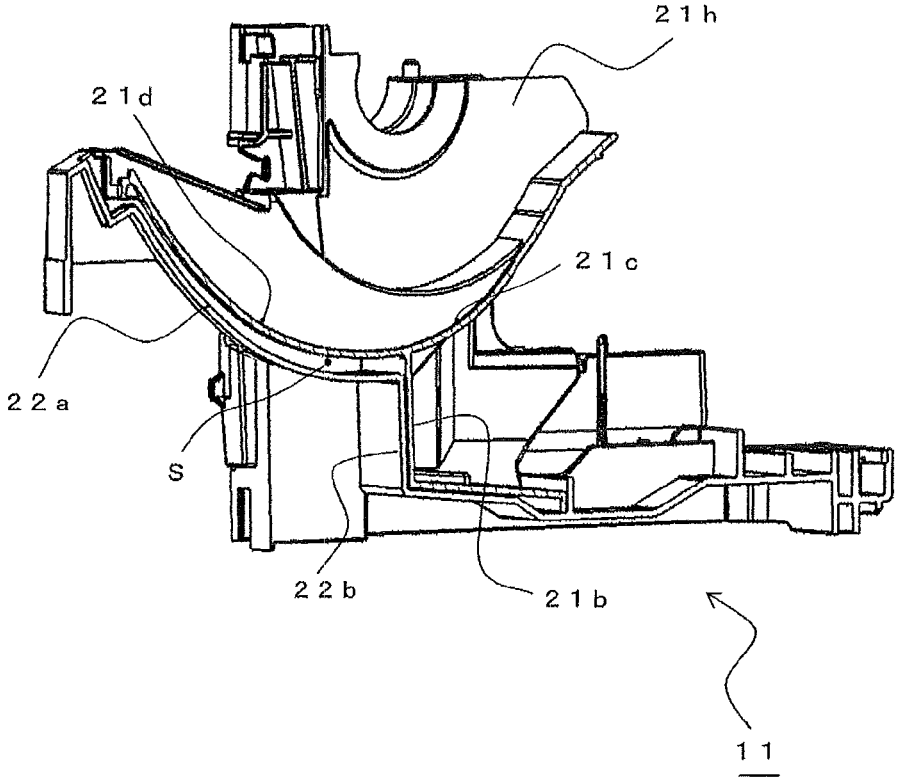
FIG. 8 is an explanatory view which shows a cross section taken along the line X-X of FIG. 7.

Next, the space S is described with reference to FIGS. 7 to 10. FIG. 7 is an explanatory view of the back case 11 formed by assembling the air outlet passage wall member 21 and the installation member 22 as seen from obliquely below. That is, the explanatory view is seen obliquely in the state in which the air outlet passage wall member 21 and the installation member 22 shown in the exploded view of FIG. 3 are assembled and rotated by 90 degrees about an axis Q (which corresponds to the rotation axis of the air sending fan 5) which extends in the longitudinal direction of the indoor unit 1 to the back side which is to be installed on the installation plate 9 (not shown). FIG. 8 is an explanatory view which shows a cross section taken along the line X-X of FIG. 7, FIG. 9 is an explanatory view which shows a cross section taken along the line Y-Y of FIG. 7, and FIG. 10 is an explanatory view which shows a cross section taken along the line Z-Z of FIG. 7.

FIG. 8 is a cross section of the left side of the back case 11 as seen from the center portion in the longitudinal direction of the indoor unit 1, and the left end of the space S formed by the air outlet passage wall member 21 and the installation member 22 is closed by a left side plate 21*h* of the air outlet passage wall member 21.

Figure 9:
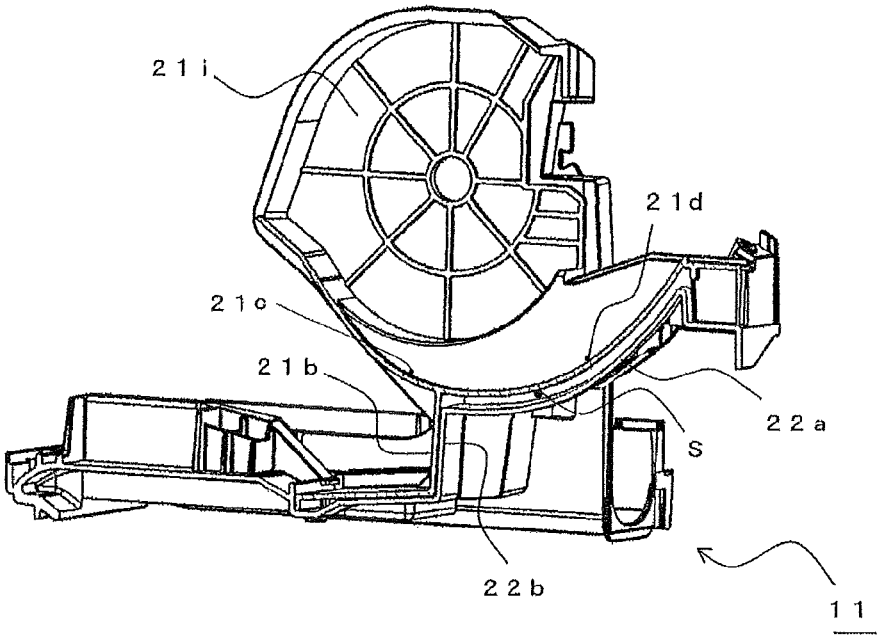
FIG. 9 is an explanatory view which shows a cross section taken along the line Y-Y of FIG. 7.

FIG. 9 is a cross section of the right side of the back case 11 as seen from the center portion in the longitudinal direction of the indoor unit 1, and the right end of the space S formed by the air outlet passage wall member 21 and the installation member 22 is closed by a right side plate 21*i* of the air outlet passage wall member 21.

Figure 10:
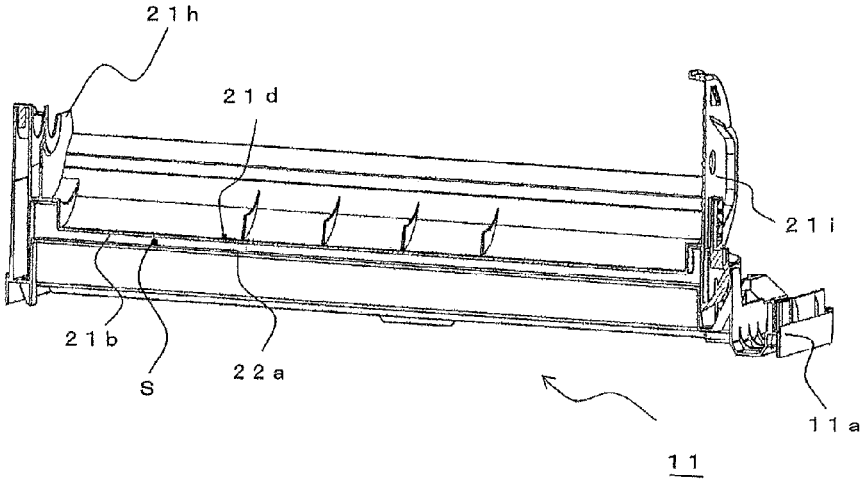
FIG. 10 is an explanatory view which shows a cross section taken along the line Z-Z of FIG. 7.

FIG. 10 shows a cross section of a slightly lower position of the drain pan section 21*b* as seen from the lower side to the upper side. In Embodiment 1, the drain pan section 21*b* of the air outlet passage wall member 21 is disposed to be in contact with the drain pan section facing section 22*b* of the installation member 22. Accordingly, the upper end of the space S is closed by the drain pan section 21*b* and the drain pan section facing section 22*b*. Further, the lower end of the space S is closed when the lower end 21*g* and the lower end 22*g* are fixed.

A motor section for rotating the air sending fan 5, a dew condensation water collecting mechanism for collecting dew condensation water formed near the front side heat exchanger 4*a* and the back side heat exchanger 4*b* and the like are disposed on the outside of the left side plate 21*h*, the right side plate 21*i*, and the outside of the left side plate 21*h*, the right side plate 21*i* in the right and left direction is covered by the side panels 12.

The installation member 22 is mounted on the installation plate 9 which is fixed on the wall surface, and the connection pipe storage section 23 is disposed in the lower part on the back side so that the refrigerant pipe which is connected to the outdoor unit (not shown) and the like are housed in the connection pipe storage section 23. The connection pipe storage section 23 is detachably mounted to part of the side panels 12 by screw fixation or the like so as to be opened and closed during installation or maintenance of the indoor unit 1.

The back case 11 is a resin molding formed by non-foam injection molding of PS (polystyrene) resin material. Further, resin material is not limited to PS, and other general purpose resin material such as ABS (acrylonitrile butadiene styrene) and PP (polypropylene).

Next, the operation will be described. In a cooling operation of an air conditioning device which includes the indoor unit 1 shown in FIG. 2, the air sending fan 5 rotates, and the room air suctioned from the air inlet 2 is cooled by the heat exchanger 4 and is blown out as conditioned air from the air outlet 3 into the room. In so doing, in the back case 11 shown in FIG. 6, a front surface of the air outlet passage wall 21*a* of the air outlet passage wall member 21 which faces to the air sending fan 5 is cooled by the conditioned air, thereby lowering the temperature. Further, a portion of the air outlet passage wall member 21 which faces to the back side heat exchanger 4*b*, that is, the back side of the upper air outlet passage wall 21*c* is also cooled by the conditioned air cooled by the back side heat exchanger 4*b*, thereby lowering the temperature. That is, at the air outlet passage wall 21*a* of the air outlet passage wall member 21, since cool air is present in both spaces on the front and back sides of the upper air outlet passage wall 21*c*, dew condensation water is not generated on the front and back surfaces of the upper air outlet passage wall 21*c*.

Next, a portion in which the space S is formed on the back side of the lower air outlet passage wall 21*d* of the air outlet passage wall 21*a* will be described. As described above, the front surface of the lower air outlet passage wall 21*d* is cooled by the conditioned air flowing in the air outlet passage 6, thereby lowering the temperature.

Since the space S is formed between the lower air outlet passage wall 21*d* and the air outlet passage wall facing section 22*a*, an air layer is formed by the air in the space S. As shown in FIGS. 8 to 10, the space S is a closed space having the length of approximately 0.5 mm to 10 mm in the front and back direction and the same length as that of the longitudinal direction of the housing 10 in the right and left direction. The space S has a configuration that rarely allows the outside air to flow in, and convection flow of the air in the space S is rarely occurred. Accordingly, the air layer in the space S provides a heat insulation effect, thereby preventing heat from being transferred between the lower air outlet passage wall 21*d* and the air outlet passage wall facing section 22*a*.

Since heat is insulated by the air layer in the space S, decrease in temperature of the lower air outlet passage wall 21*d* is prevented from being transferred to the air outlet passage wall facing section 22*a*. Accordingly, the temperature of the air outlet passage wall facing section 22*a* is not lowered, even if the lower air outlet passage wall 21*d* is cooled. Since the space on the back side of the installation member 22 is the connection pipe storage section 23, the room air may enter the connection pipe storage section 23. However, even if the room air exists on the back side of the air outlet passage wall facing section 22*a*, it is not cooled since the air outlet passage wall facing section 22*a* is not cooled, thereby preventing dew condensation water from being formed on the back surface of the installation member 22. Accordingly, there is no need of providing a water droplet prevention unit such as a dew condensation water collecting mechanism in the connection pipe storage section 23.

Dew condensation water of room air which is suctioned from the air inlet 2 and cooled by the back side heat exchanger 4*b* drops onto the lower part of the back side heat exchanger 4*b* and is collected in the drain pan section 21*b*. The collected dew condensation water together with the drainage water collected in the drain pan 7 under the front side heat exchanger 4*a* is discharged to the outside of the room by a drainage mechanism (not shown) disposed on one of the right and left sides in the longitudinal direction inside of the side panel 12.

In the conventional example of Patent Literature 1, a dew condensation water collection mechanism is necessary in a portion on the back surface of the air outlet passage wall member of the back case which faces to the connection pipe storage section since dew condensation water is generated on this portion. On the other hand, in Embodiment 1, since the back case 11 is composed of two members, which are the air outlet passage wall member 21 and the installation member 22 and the space S is disposed between the air outlet passage wall member 21 and the installation member 22, the indoor unit 1 can be provided in which dew condensation water is not generated on the back surface of the installation member 22, that is, the connection pipe storage section 23. Accordingly, the space S can replace the dew condensation water collecting configuration of the back case 11, which has been necessary, thereby reducing the cost and resources. Further, the configuration can be simplified.

Further, in Embodiment 1, a space on the back side of the installation member 22 can be effectively used since dew condensation water is not generated on the back surface of the installation member 22. The space is provided as the pipe storage section 23 for housing the connection pipe. Since the water droplet prevention unit such as a dew condensation water collecting mechanism is not directly exposed into the space, a piping operation can be easily performed during installation and maintenance of the indoor unit 1, thereby reducing the working time.

Further, in order to prevent room air from flowing into and flowing out of the space S, the outer periphery of the space S is preferably welded so as to seal the space S. Alternatively, air can be prevented from flowing into and flowing out of the space S by fitting each of the resin components, thereby obtaining heat insulation effect by the air layer.

In addition, flow of air between the space S and outside can be prevented in a reliable manner by welding or affixing the sealing material around the space S so as to seal between the air outlet passage wall member 21 and the installation member 22, and accordingly, convection of air does not occur in the space S, thereby further improving the heat insulation effect.

In Embodiment 1, since the back case 11 is composed of two members (the air outlet passage wall member 21 and the installation member 22), each of the air outlet passage wall member 21 and the installation member 22 can be formed in a simplified shape compared with the case of integral molding. For example, the shape of the back side of the air outlet passage wall member 21 is the drain pan section 21*b* having an L shape in cross section, and the length in the up and down direction can be smaller compared with the case of integral molding (see FIG. 4). On the other hand, the shape of the front side of the installation member 22 is connected from the air outlet passage wall facing section 22*a* to the drain pan section facing section 22*b*, and extends to the upper end 22*d* (see FIG. 5), which is a simple shape.

The back case 11 is made by injection molding of the resin material. Since the back case 11 is composed of two members having a simple shape, a mold can be easily slid during resin molding. Particularly, although it is difficult for integral molding of the back case of Patent Literature 1, the drain pan section 21*b* can be disposed at a lower position so that the drain pan section 21*b* having the larger depth can be formed. Accordingly, the back side heat exchanger 4*b* can be large in the up and down direction, thereby improving the performance of the air conditioning device.

Since the back case 11 is composed of two members of the air outlet passage wall member 21 and the installation member 22, the following effect can also be obtained.

Although the material of the back case 11 is described above, the air outlet passage wall member 21 and the installation member 22 may not be necessarily made of the same material. The installation member 22 is exposed to the side surfaces and back surface of the cuboid indoor unit 1. That is, as shown in FIG. 3, the back case side surface 11*a* which is exposed to the side surfaces are the side surfaces of the installation member 22. On the other hand, the air outlet passage wall member 21 is a member which is housed in the indoor unit 1 and is not seen from the outside. Accordingly, the air outlet passage wall member 21 and the installation member 22 can be made of different material, for example, the air outlet passage wall member 21 is made of a material suitable in terms of strength and function, while the installation member 22 is made of a material suitable for design. For example, the air outlet passage wall member 21 can be made of a recycled material for resource-saving, thereby contributing to the natural environment and reducing the cost.

Further, when the shape of the heat exchanger 4 is changed in an attempt of improving the performance of the indoor unit 1, there is an effect that only the air outlet passage wall member 21 can be modified. In the case where the back case is integrally molded, remolding of the entire back case is necessary depending on the modification of the heat exchanger 4. On the other hand, in the back case 11, only the air outlet passage wall member 21 may be modified while the shape of the installation member 22 may remain the same. This also allows for resource-saving and reduction in cost.

In Embodiment 1, the air outlet passage wall member 21 includes the drain pan section 21*b*, and the space S is formed between the back surface of the lower air outlet passage wall 21*d* of the air outlet passage wall member 21 and the installation member 22 under the drain pan section 21*b* and the drain pan section facing section 22*b*. However, the invention is not limited thereto, and the space may be provided across the entire area in the up and down direction in a portion in which the air outlet passage wall member 21 and the installation member 22 are arranged in parallel in the front and back direction. The range of the space S in the up and down direction may be large as possible. The space S is provided across the entire area in the longitudinal direction of the back case 11.

Figure 11:
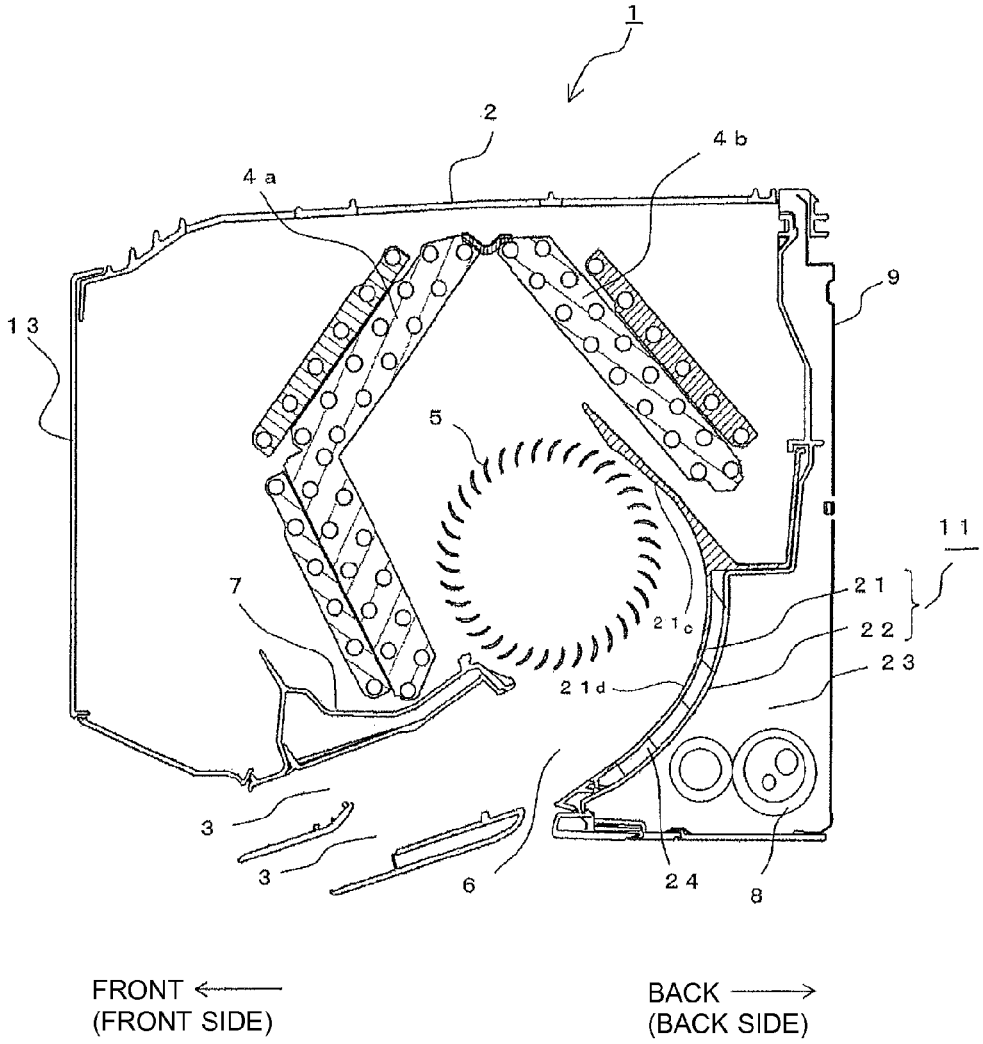
FIG. 11 is a vertical sectional view of another configuration example of the indoor unit of the air conditioning device according to Embodiment 1 of the present invention.

FIG. 11 is a vertical sectional view of another configuration example of the indoor unit of the air conditioning device according to Embodiment 1 of the present invention. References which are the same as those of FIG. 2 denote the same or corresponding elements. In this example, a heat insulation material 24 is disposed in the space S shown in FIG. 2.

In providing the heat insulation material 24 in the space S, the air outlet passage wall member 21 and the installation member 22 may be assembled while the heat insulation material 24 is adhered on the back surface of the air outlet passage wall 21*a* of the air outlet passage wall member 21, more specifically, on the back surface of the lower air outlet passage wall 21*d*, or alternatively, on the front surface of the air outlet passage wall facing section 22*a* of the installation member 22. The heat insulation material 24 can provide more reliable heat insulation of the lower air outlet passage wall 21*d* of the air outlet passage wall member 21 and the installation member 22 compared with heat insulation by air. As a result, even if the temperature of the lower air outlet passage wall 21*d* of the air outlet passage wall member 21 is lowered by the cooled conditioned air, dew condensation water can be prevented from being formed on the back surface of the installation member 22 in a reliable manner since the temperature of the installation member 22 is not lowered and the air in the connection pipe storage section 23 is not cooled.

When the heat insulation material 24 is bonded and fixed on the back surface of the lower air outlet passage wall 21*d* of the air outlet passage wall member 21 by using adhesive and is pressed by the installation member 22 from the back side, detachment of the heat insulation material 24 due to time elapse can be prevented. Further, the heat insulation material 24 is not exposed to the connection pipe storage section 23, and there is no risk of peeling off of the heat insulation material 24 during a piping operation.

Fixation of the heat insulation material 24 is not limited to bonding by adhesive. For example, a fixation frame may be integrally formed of a piece or a projection which is folded back to the back side on the back surface of the lower air outlet passage wall 21*d*, and the heat insulation material 24 may be fitted into the fixation frame and fixed thereto. However, bonding fixation by using adhesive is advantageous in that the heat insulation material 24 can be ensured to be in contact with the back surface of the lower air outlet passage wall 21*d*.

In the most simple manner, the heat insulation material 24 may be compressed and inserted between the lower air outlet passage wall 21*d* and the air outlet passage wall facing section 22*a* so that the air outlet passage wall member 21 and the installation member 22 may be assembled to form the back case 11.

In the indoor unit 1, foamed resin made by foam molding is used as the heat insulation material 24 taking advantage of high heat insulation property and general versatility, and specifically, expanded polystyrene (foam polystyrene) made by foam molding of polystyrene (PS) having particularly high general versatility is used. The heat insulation material 24 is not limited to expanded polystyrene, and may be other foamed resin such as expanded polyethylene and expanded polyurethane. Further, glass wool made of glass fiber rather than foamed resin may also be used.

Further, the heat insulation material 24 disposed in the space S may not be necessarily one type, and several types of heat insulation materials may be combined. For example, a plurality of heat insulation materials by recycle may be used.

In addition, the heat insulation material 24 may not be provided across the entire area but may be provided only in part of the space S in the up and down direction and the right and left direction. However, the heat insulation material 24 is desirably provided across the entire area for improvement of heat insulation property.

As described above, in Embodiment 1, the indoor unit of the air conditioning device can be provided in which the back case 11 has a configuration in which the air outlet passage wall member 21 that forms the air outlet passage 6 of air which is blown out from the air sending fan 5 and the installation member 22 which is located on the back side of the air outlet passage wall member 21 and is mounted on the installation plate fixed on the wall surface of the room are disposed in parallel in the front and back direction, and the first space S is formed between the back surface of the air outlet passage wall 21*a* of the air outlet passage wall member 21 and the installation member 22, thereby preventing dew condensation water from being formed on the back surface of the back case 11 during a cooling operation.

Further, in Embodiment 1, since the heat insulation material 24 is disposed in the first space S, heat insulation effect between the air outlet passage wall 21*a* and the air outlet passage wall facing section 22*a* can be improved.

Further, in Embodiment 1, since the heat insulation material 24 is in contact with and fixed on the back surface of the air outlet passage wall member 21 and the installation member 22 is fixed on the back side of the heat insulation material 24, the back surface of the air outlet passage wall 21*a* can be ensured to be in contact with the heat insulation material 24.

Further, in Embodiment 1, the installation member 22 is longer than the air outlet passage wall member 21 in the up and down direction, and the first space S is formed between the air outlet passage wall member 21 and the installation member 22 when the lower end 21*g* of the air outlet passage wall member 21 is fixed to the lower end 22*g* of the installation member 22 and the installation member 22 is assembled to the air outlet passage wall member 21 while extending upward from the air outlet passage wall member 21. In addition to that, two members (the air outlet passage wall member 21 and the installation member 22) of the back case 11 may have the shape which is easily formed by resin molding.

Further, in Embodiment 1, the back case 11 has a configuration in which the air outlet passage wall member 21 that forms the air outlet passage 6 of air which is blown out from the air sending fan 5 and the installation member 22 which is located on the back side of the air outlet passage wall member 21 and is mounted on the installation plate fixed on the wall surface of the room are disposed in parallel in the front and back direction, and the air outlet passage wall member 21 includes the drain pan section 21*b* having an L-shape in the cross section under the heat exchanger 4*b* which is the heat exchanger 4 and is disposed on the back side of the air sending fan 5 so that droplets of dew condensation water from the heat exchanger 4*b* is received in the drain pan section 21*b*. Accordingly, two members (the air outlet passage wall member 21 and the installation member 22) of the back case 11 may have the shape which is easily formed by resin molding and may be made of different materials for resource-saving.

Further, in Embodiment 1, since the pipe storage section 23 for housing the connection pipe is formed on the back side of the installation member 22, a piping operation can be easily performed during installation and maintenance of the indoor unit 1.

Embodiment 2

Figure 12:
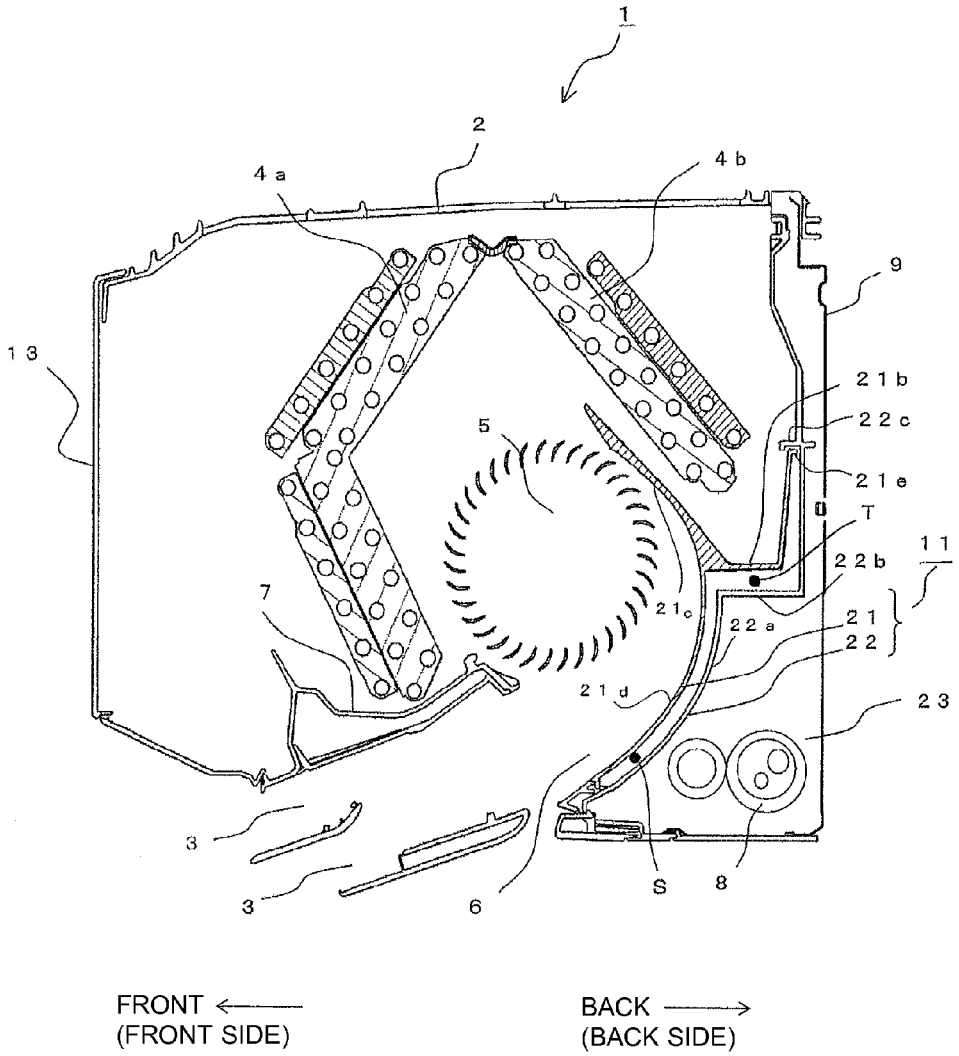
FIG. 12 is a vertical sectional view of the indoor unit of the air conditioning device according to Embodiment 2 of the present invention.

FIG. 12 is a vertical sectional view of the indoor unit of the air conditioning device according to Embodiment 2 of the present invention. In the drawing, references which are the same as those of FIG. 2 denote the same or corresponding elements.

In Embodiment 2, a space T (second space T) is disposed between the drain pan section 21*b* of the air outlet passage wall member 21 and the drain pan section facing section 22*b* of the installation member 22 so as to be continuous from the space S (first space S) between the lower air outlet passage wall 21*d* of the air outlet passage wall member 21 and the air outlet passage wall facing section 22*a* of the installation member 22. The second space T (hereinafter, referred to as space T) has an L-shape in the vertical cross section.

In a cooling operation of the air conditioning device, the room air which is suctioned from the air inlet 2 exchanges heat with the refrigerant flowing in the refrigerant pipe in the front side heat exchanger 4*a* and the back side heat exchanger 4*b* so that the temperature of the room air is lowered for air-conditioning. When the room air is cooled by the back side heat exchanger 4*b* around the back case 11, water vapor contained in the room air becomes dew and is condensed on the member which forms the back side heat exchanger 4*b* such as a fin, and then gradually flows downward due to the gravitational force.

Dew condensation water drops from the back side heat exchanger 4*b* and is received in the drain pan section 21*b* having an L-shape in the cross section of the air outlet passage wall member 21. Dew condensation water received in the drain pan section 21*b* is guided to the outside of the room by a drainage mechanism (not shown), and the temperature of the dew condensation water is the same as that of the conditioned air and is lower than that of the room air. Accordingly, in the case where the drain pan section 21*b* of the air outlet passage wall member 21 is in contact with the drain pan section facing section 22*b* of the installation member 22 as similar to Embodiment 1, the drain pan section 21*b* of the air outlet passage wall member 21 and the drain pan section facing section 22*b* of the installation member 22 may be cooled by the dew condensation water when dew condensation water is stored in the drain pan section 21*b*. When the drain pan section facing section 22*b* is cooled, air around the drain pan section facing section 22*b* of the connection pipe storage section 23 which is a space on the back side of the installation member 22 is cooled and dew condensation water is generated on the back surface of the drain pan section facing section 22*b*.

In Embodiment 2, the space T is formed between the drain pan section 21*b* of the air outlet passage wall member 21 and the drain pan facing section 22*b* of the installation member 22. Both ends of the indoor unit 1 in the longitudinal direction have the same configuration as that of FIGS. 8, 9, and the right and left ends of the space T are closed by a left side plate 21*h*, a right side plate 21*i*. Further, the upper end of the space T is closed by fitting the claws 21*e* of the air outlet passage wall member 21 and the claw fixation section 22*c* of the installation member 22. Further, the lower end of the space S which is continuous from the space T is closed by aligning the lower end 21*g* of the air outlet passage wall member 21 and the lower end 22*g* of the installation member 22 for bolt fixation as similar to Embodiment 1. The space S which communicates with the space T forms a closed space that does not allow the outside air from freely flowing in and out. The air layer in the spaces S, T allows for heat insulation between the lower air outlet passage wall 21*d* of the air outlet passage wall member 21 and the air outlet passage wall facing section 22*a* of the installation member 22 and between the drain pan section 21*b* and the drain pan section facing section 22*b*.

That is, the air in the spaces S, T can prevent decrease in temperature of the air outlet passage wall member 21 due to the conditioned air and the dew condensation water from being transferred to the installation member 22 to avoid decrease in temperature of the installation member 22 even if the air outlet passage wall member 21 is cooled. That is, since the air temperature near the back surface of the installation member 22 is not cooled by the installation member 22, dew condensation water can be prevented from being generated on the back surface of the installation member 22. As a result, there is no need of providing a water droplet prevention unit such as the dew condensation water collecting mechanism in the connection pipe storage section 23.

In Embodiment 2, in addition to Embodiment 1, the air layer in the space T provides heat insulation between the drain pan section 21*b* and the drain pan section facing section 22*b*. As a result, dew condensation water is prevented from being generated on the back surface of the back case 11, even if the dew condensation water around the back side heat exchanger 4*b* is collected in the drain pan section 21*b* and cools the drain pan section 21*b*.

Figure 13:
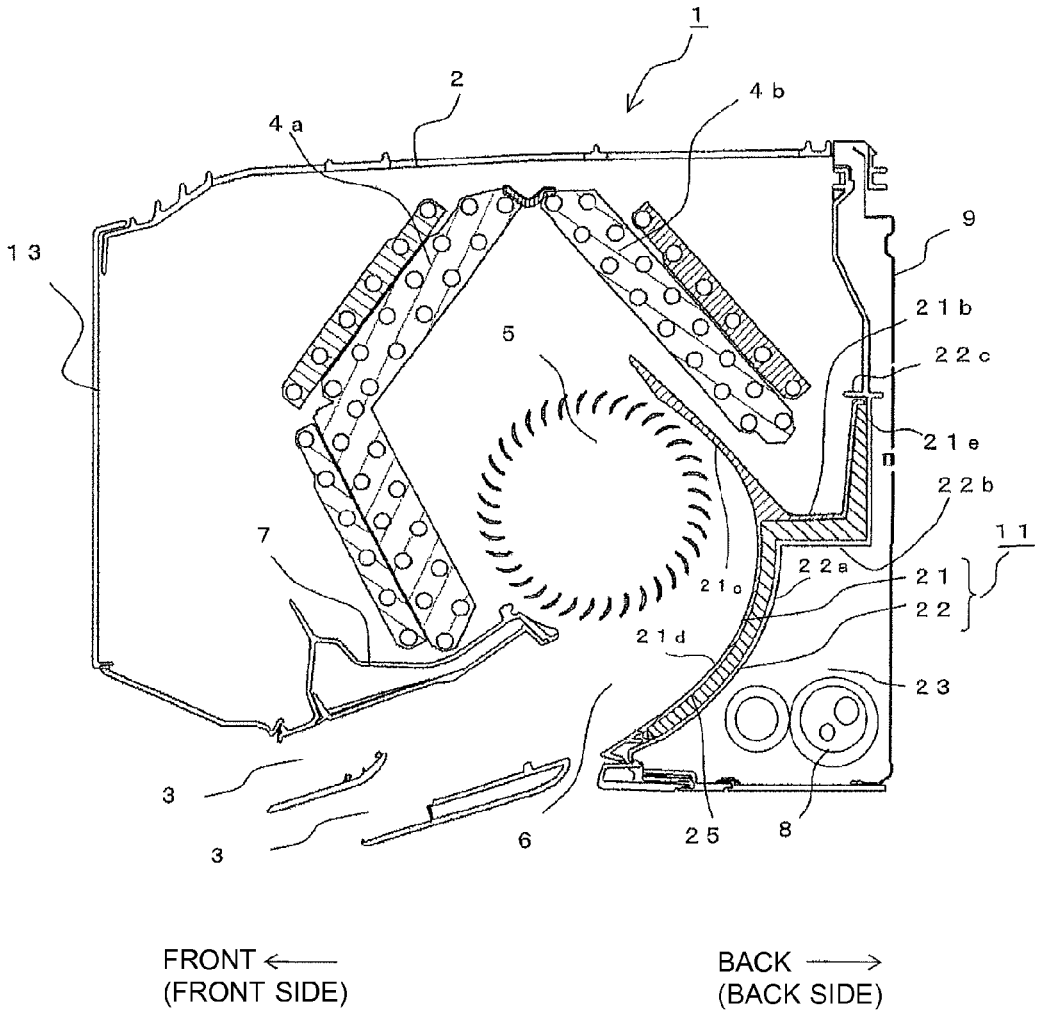
FIG. 13 is a vertical sectional view of another configuration example of the indoor unit of the air conditioning device according to Embodiment 2 of the present invention.

FIG. 13 is a vertical sectional view of the indoor unit 1 which shows another configuration example of Embodiment 2. References which are the same as those of FIG. 2 denote the same or corresponding elements. In this configuration, the heat insulation material 25 is disposed in the spaces S, T. As similar to Embodiment 1, heat insulation effect can be further improved by providing the heat insulation material 25 in the spaces S, T, and dew condensation water can be prevented from being generated on the back surface of the back case 11. Materials and installation methods of the heat insulation material 25 are the same as those of Embodiment 1.

In this example, the heat insulation material 25 is provided across the entire area in the up and down direction and the right and left direction of the space S and space T. However, the heat insulation material 25 may not be provided across the entire area but may be provided, for example, only in the portion of the space S. However, the heat insulation material 25 is desirably provided across the entire area for improvement of heat insulation property. As similar to Embodiment 1, the heat insulation material 25 may not be integrally formed but may be formed by combining a plurality of members.

As described above, in Embodiment 2, the indoor unit of the air conditioning device can be provided in which the air outlet passage wall member 21 includes the drain pan section 21*b* having an L-shape in the cross section under the heat exchanger 4*b* which is disposed on the back side of the air sending fan 5 so as to receive droplets of dew condensation water from the heat exchanger 4*b*, and the second space T is formed between the drain pan section 21*b* and the installation member 22 such that dew condensation water is prevented from being generated on the back surface of the back case 11 during a cooling operation.

In Embodiment 2, since the heat insulation material 25 is disposed in the second space T, heat insulation effect between the drain pan section 21*b* and the drain pan section facing section 22*b* can be improved.

Embodiment 3

Figure 14:
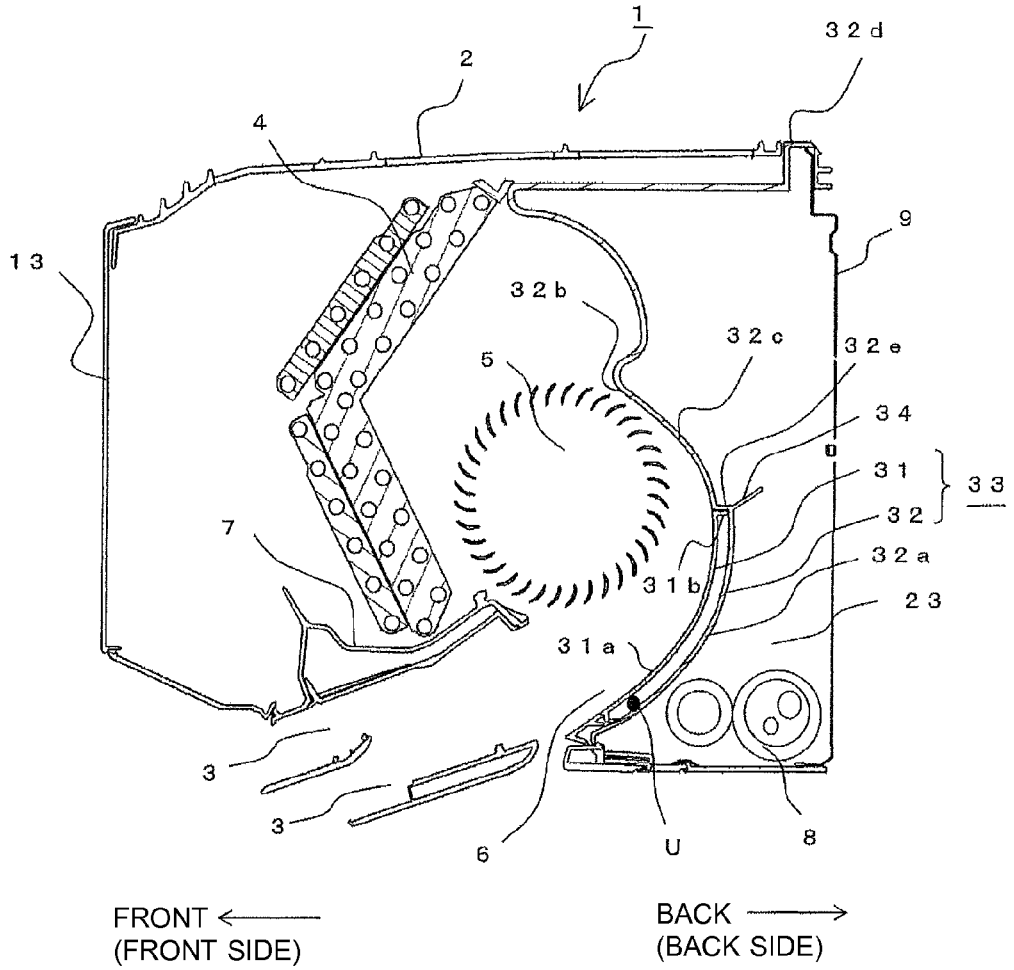
FIG. 14 is a vertical sectional view of the indoor unit of the air conditioning device according to Embodiment 3 of the present invention.

FIG. 14 is a vertical sectional view of the indoor unit of the air conditioning device according to Embodiment 3 of the present invention. Embodiment 3 is directed to the indoor unit 1 in which the heat exchanger 4 is disposed only on the front side of the air sending fan 5 and is not disposed on the back side of the air sending fan 5. In the drawing, references which are the same as those of FIG. 2 denote the same or corresponding elements. In the drawing, references which are the same as those of FIG. 2 denote the same or corresponding elements.

In the indoor unit 1 of the air conditioning device according to Embodiment 3, the air inlet 2 is disposed on the top and the air outlet 3 is disposed in the lower part of the front side as similar to Embodiment 1. The indoor unit 1 includes the air sending fan 5 that sends the room air from the air inlet 2 to the air outlet 3, the heat exchanger 4 which is disposed at the upstream side of the air sending fan 5, and a back case 33 which is disposed on the back side of the air sending fan 5 and supports the heat exchanger 4, and is hung on the wall surface of the room.

The back case 33 is composed of two members, which are an air outlet passage wall member 31 and an installation member 32. The air outlet passage wall member 31 and the installation member 32 are disposed in parallel and spaced from each other in the front and back direction, and form a space U (first space) between the back surface of the air outlet passage wall member 31 and the front surface of the installation member 32. The first space U (hereinafter, referred to as space U) is a space of, for example, approximately 0.5 mm to 10 mm in the front and back direction and approximately the same length as that of the longitudinal direction of the housing 10 in the right and left direction, and is closed to an extent such that air around the housing 10 is not allowed to freely flowing in and out.

Further, the air outlet passage wall member 31 is longer than the installation member 32 in the up and down direction, and includes a lower air outlet passage wall 31*a* which forms the back side wall of the air outlet passage 6. The installation member 32 which is longer than the air outlet passage wall member 31 in the up and down direction includes an air outlet passage wall facing section 32*a* which faces the back side of the lower air outlet passage wall 31*a* via the space U and an upper air outlet passage wall 32*c* which is continuous from the upper end of the air outlet passage wall facing section 32*a* and forms an upper part of the air outlet passage wall. The air outlet passage wall upstream end 32*b* is located at a position closest to the air sending fan 5 in the back case 33 in the vertical cross section of the indoor unit 1, and the air outlet passage 6 is formed from the vicinity of the air outlet passage wall upstream end 32*b* to the air outlet 3. That is, an air outlet passage wall is formed of the upper air outlet passage wall 32*c* of the installation member 32 and the lower air outlet passage wall 31*a* of the air outlet passage wall member 31 in a curve concave to the air outlet passage 6. The upper air outlet passage wall 32*c* corresponds to the upper air outlet passage wall 21*c* of Embodiment 1, while the lower air outlet passage wall 31*a* corresponds to the lower air outlet passage wall 21*d* of Embodiment 1.

The air outlet passage wall member 31 and the installation member 32 are assembled by fitting a claw 31*b* formed on the upper end of the air outlet passage wall member 31 with the claw fixation section 32*e*. The lower end of the back case 33 has a shape similar to that of Embodiment 1. The back case 33 is installed on the wall surface of the room to be air-conditioned after the air outlet passage wall member 31 and the installation member 32 are assembled.

The upper end 32*d* of the installation member 32 is located at the same level as the top of the housing 10, and the claws formed at a plurality of positions in the longitudinal direction of the upper end 32*d* are hooked on the metal installation plate 9 so as to be fixed thereto.

Further, the installation member 32 includes a rib 34 near the back surface of the claw fixation section 32*e*. The rib 34 is provided for collecting dew condensation water generated above the rib 34, as similar to the drain pan section 21*b* of Embodiment 1. The rib 34 is integrally formed with the installation member 32 and has a cross sectional shape which obliquely extends upward from the back surface of the installation member 32. The right and left direction of the rib 34 extends in the longitudinal direction of the indoor unit 1 and has the same length as that of the indoor unit 1 in the right and left direction. The rib 34 is formed to be slightly downwardly inclined from the center portion in the right and left direction toward each of the right and left ends. The rib 34 may not be integrally formed with the installation member 32, and may be fixed to the back surface of the installation member 32 by adhesive, claw fixation, bolt fixation or the like.

Next, the operation will be described. In the cooling operation of the air conditioning device which includes the indoor unit 1, as similar to Embodiment 1, the air sending fan 5 rotates, and the room air suctioned from the air inlet 2 is cooled by the heat exchanger 4 and is blown out as conditioned air from the air outlet 3 into the room. In so doing, the front surface of the air outlet passage wall member 31 and the installation member 32 which face the air sending fan 5, that is, a portion extending from the air outlet passage wall upstream end 32*b* to the air outlet 3 via the upper air outlet passage wall 32*c*, the lower air outlet passage wall 31*a* is cooled by the conditioned air, thereby lowering the temperature.

On the back surface extending from the air outlet passage wall upstream end 32*b* to the upper air outlet passage wall 32*c* of the installation member 32, the air near the back side of the installation member 32 is cooled and dew condensation water is generated. The generated dew condensation water flows downward along the back surface of the upper air outlet passage wall 32*c* and is received by the inclined rib 34. Then, the dew condensation water flows toward one of the right and left ends in the longitudinal direction, and is discharged together with the drainage water collected in the drain pan 7 on the front side of the air sending fan 5 to the outside of the room by a drainage mechanism (not shown) which is disposed inside the side panels 12 (see FIG. 1).

Although the temperature of the front surface of the lower air outlet passage wall 31*a* decreases due to the conditioned air having low temperature, decrease in temperature of the lower air outlet passage wall 31*a* is not transferred to the air outlet passage wall facing section 32*a* since the air layer in the space U which is formed between the air outlet passage wall member 31 and the installation member 32 can provide heat insulation. The temperature of the air outlet passage wall facing section 32*a* does not decrease, and accordingly, air in the vicinity of the back surface of the air outlet passage wall facing section 32*a* is not cooled, thereby preventing dew condensation on the back surface of the air outlet passage wall facing section 32*a*. Accordingly, there is no need of providing a water droplet prevention unit such as a dew condensation water collecting mechanism in the connection pipe storage section 23 located on the back surface of the back case 33 as similar to Embodiment 1.

Further, although the space U is provided under the rib 34 in the up and down direction, the space U may extend to an upper area. The space U having a large area in the up and down direction can perform heat insulation effect across the large area. Prevention of dew condensation in a large area on the back surface of the back case 33 can reduce the amount of dew condensation water collected in the rib 34 and decrease the length of the rib 34 in the front and back direction. Alternatively, the rib 34 may not be provided depending on configurations.

Further, as similar to Embodiment 1, the heat insulation material provided in the space U can improve heat insulation effect. Moreover, as similar to Embodiment 1, in order to prevent the outside air from flowing in and out of the space U, the periphery of the space U between the air outlet passage wall member 31 and the installation member 32 is desirably sealed by welding or the like.

Further, as similar to Embodiment 1, fixation of the air outlet passage wall member 31 and the installation member 32 by using the claw 31*b* and the claw fixation section 32*e* and fixation of the upper end 32*d* to the installation plate 9 are not limited to the fixation described in Embodiment 3, and may be performed by fitting of other shapes, or alternatively, claw fixation, bolt fixation or adhesion may also be possible.

As described above, Embodiment 3 can provide the indoor unit of the air conditioning device which is hung on a wall surface of a room which includes the air sending fan 5 which sends room air from the air inlet 2 disposed at an upper part to the air outlet 3 disposed at a lower part on the front side, the heat exchanger 4 disposed at a upstream side of the air sending fan 5, and the back case 33 which is located close to the wall surface with respect to the air sending fan 5 and supports the heat exchanger 4, wherein the back case 33 is composed of the air outlet passage wall member 31 which forms the air outlet passage 6 for air blown out from the air sending fan 5 and the installation member 32 which is located on the back side of the air outlet passage wall member 31 and is mounted on the installation plate which is fixed on the wall surface of the room with the air outlet passage wall member 31 and the installation member 32 being arranged in parallel in the front and back direction, and the first space U is formed between the back surface of the air outlet passage wall 31*a* of the air outlet passage wall member 31 and the installation member 32 so that dew condensation on the back surface of the back case 33 can be prevented during a cooling operation.

REFERENCE SIGNS LIST

1: indoor unit of air conditioning device 2: air inlet 3: air outlet 4: heat exchanger 4*a*: front side heat exchanger 4*b*: back side heat exchanger

5: air sending fan 6: air outlet passage 7: drain pan 8: connection pipe 9: installation plate 10: housing 11: back case 11*a*: back case side surface 12: side panel 13: front panel 21: air outlet passage wall member 21*a*: air outlet passage wall 21*b*: drain pan section 21*c*: upper air outlet passage wall 21*d*: lower air outlet passage wall 21*e*: claw

21*f*: insertion hole 21*g*: lower end 21*h*: left side plate 21*i*: right side plate 22: installation member 22*a*: air outlet passage wall facing section 22*b*: drain pan section facing section 22*c*: claw fixation section 22*d*: upper end

22*f*: screw hole 22*g*: lower end 23: connection pipe storage section

24: heat insulation material 25: heat insulation material 31: air outlet passage wall member 31*a*: lower air outlet passage wall 31*b*: claw

32: installation member 32*a*: air outlet passage wall facing section 32*b*: air outlet passage wall upstream end 32*c*: upper air outlet passage wall 32*d*: upper end 32*e*: claw fixation section 33: back case 34: rib S: first space T: second space U: first space Q: axis extending in the longitudinal direction

What is claimed is:

1. An indoor unit of an air conditioning device which is to be installed on a wall surface of a room, wherein the indoor unit has a back side, which faces the wall surface in a rearward direction when the indoor unit is installed, and a front side, which is opposite to the back side and which faces away from the wall surface in a frontward direction when the indoor unit is installed, the indoor unit comprising:

an air sending fan which sends room air from an air inlet disposed at an upper part of the indoor unit to an air outlet disposed at a lower part of the front side;

a heat exchanger disposed at a position upstream of the air sending fan; and a back case which is located between the air-sending fan and the wall surface and rearward of the air outlet when the indoor unit is installed, wherein the back case supports the heat exchanger, the back case includes an air outlet passage wall member, which is located on a rearward side of the air sending fan and which forms an air outlet passage for air blown out from the air sending fan, and an installation member, which is located on a rearward side of the air outlet passage wall member and is mounted on an installation plate when the indoor unit is installed, the installation plate is for fixing the indoor unit on the wall surface, the air outlet passage wall member and the installation member are arranged in parallel in a front-to-back direction, and a space is formed between a rearward surface of an air outlet passage wall of the air outlet passage wall member and the installation member.

2. The indoor unit of the air conditioning device of claim 1, wherein a heat insulation material is disposed in the space.

3. The indoor unit of the air conditioning device of claim 1, wherein the air outlet passage wall member includes a drain pan section, which has an L-shaped cross-section and is located under the heat exchanger and rearward of the air sending fan, so that droplets of dew condensation water generated on the heat exchanger and dropped therefrom are received in the drain pan section.

4. The indoor unit of the air conditioning device of claim 3, wherein the space is a first space, and a second space is formed between the drain pan section and the installation member.

5. The indoor unit of the air conditioning device of claim 4, wherein a heat insulation material is disposed in the second space.

6. The indoor unit of the air conditioning device of claim 2, wherein the heat insulation material is fixed in contact with the back surface of the air outlet passage wall member, and the installation member is fixed on a rearward side of the heat insulation material.

7. The indoor unit of the air conditioning device of claim 1, wherein the installation member is longer than the air outlet passage wall member in a vertical direction when the indoor unit is installed, a lower end of the air outlet passage wall member is fixed to a lower end of the installation member, and the installation member is assembled while extending upward from the air outlet passage wall member.

8. The indoor unit of the air conditioning device of claim 1, wherein a pipe storage section that houses a connection pipe is disposed on a rearward side of the installation member.

9. The indoor unit of the air conditioning device of claim 2, wherein the air outlet passage wall member includes a drain pan section, which has an L-shaped cross-section and is located under the heat exchanger and on a rearward side of the air sending fan so that droplets of dew condensation water generated on the heat exchanger and dropped therefrom are received in the drain pan section.

10. The indoor unit of the air conditioning device of claim 5, wherein the heat insulation material is fixed in contact with the back surface of the air outlet passage wall member, and the installation member is fixed on a rearward side of the heat insulation material.

11. The indoor unit of the air conditioning device of claim 2, wherein the installation member is longer than the air outlet passage wall member in a vertical direction when the indoor unit is installed, a lower end of the air outlet passage wall member is fixed to a lower end of the installation member, and the installation member is assembled while extending upward from the air outlet passage wall member.

12. The indoor unit of the air conditioning device of claim 3, wherein the installation member is longer than the air outlet passage wall member in a vertical direction when the indoor unit is installed, a lower end of the air outlet passage wall member is fixed to a lower end of the installation member, and the installation member is assembled while extending upward from the air outlet passage wall member.

13. The indoor unit of the air conditioning device of claim 4, wherein the installation member is longer than the air outlet passage wall member in a vertical direction when the indoor unit is installed, a lower end of the air outlet passage wall member is fixed to a lower end of the installation member, and the installation member is assembled while extending upward from the air outlet passage wall member.

14. The indoor unit of the air conditioning device of claim 5, wherein the installation member is longer than the air outlet passage wall member in a vertical direction when the indoor unit is installed, a lower end of the air outlet passage wall member is fixed to a lower end of the installation member, and the installation member is assembled while extending upward from the air outlet passage wall member.

15. The indoor unit of the air conditioning device of claim 6, wherein the installation member is longer than the air outlet passage wall member in a vertical direction when the indoor unit is installed, a lower end of the air outlet passage wall member is fixed to a lower end of the installation member, and the installation member is assembled while extending upward from the air outlet passage wall member.

16. The indoor unit of the air conditioning device of claim 9, wherein the installation member is longer than the air outlet passage wall member in a vertical direction when the indoor unit is installed, a lower end of the air outlet passage wall member is fixed to a lower end of the installation member, and the installation member is assembled while extending upward from the air outlet passage wall member.

17. The indoor unit of the air conditioning device of claim 10, wherein the installation member is longer than the air outlet passage wall member in a vertical direction when the indoor unit is installed, a lower end of the air outlet passage wall member is fixed to a lower end of the installation member, and the installation member is assembled while extending upward from the air outlet passage wall member.

18. The indoor unit of the air conditioning device of claim 2, wherein a pipe storage section that houses a connection pipe is disposed on a rearward side of the installation member.

* * * * *